US006945542B2

(12) United States Patent
Stewart

(10) Patent No.: US 6,945,542 B2
(45) Date of Patent: Sep. 20, 2005

(54) SKATEBOARD TRUCK SHIELD

(76) Inventor: Gregor P. Stewart, 4371 N. 4th St., Fresno, CA (US) 93726

( * ) Notice: Subject to any disclaimer, the term of this patent is extended or adjusted under 35 U.S.C. 154(b) by 6 days.

(21) Appl. No.: 10/263,489

(22) Filed: Oct. 3, 2002

(65) Prior Publication Data

US 2004/0066014 A1 Apr. 8, 2004

(51) Int. Cl.[7] ..... A63C 17/02
(52) U.S. Cl. ..... 280/11.27; 280/811; 280/87.042
(58) Field of Search ..... 280/11.27, 11.28, 280/809, 811, 825, 87.041, 87.042

(56) References Cited

U.S. PATENT DOCUMENTS

| | | | | | |
|---|---|---|---|---|---|
| 2,245,769 | A | | 6/1941 | Flamm | |
| 2,405,000 | A | | 7/1946 | Whited | |
| 4,165,090 | A | * | 8/1979 | Feddersohn et al. | 280/87.042 |
| 4,214,768 | A | * | 7/1980 | Dominy et al. | 280/809 |
| 4,245,848 | A | * | 1/1981 | Dudouyt | 280/11.28 |
| 4,824,139 | A | * | 4/1989 | Robbins | 280/816 |
| 5,560,625 | A | * | 10/1996 | Kuykendall | 280/11.221 |
| 5,806,860 | A | * | 9/1998 | Conte | 280/11.231 |
| 5,879,013 | A | * | 3/1999 | Shih | 280/11.28 |
| 6,056,302 | A | | 5/2000 | Smith | |
| 6,416,081 | B1 | * | 7/2002 | Goodman | 280/809 |
| 6,581,943 | B2 | * | 6/2003 | Wegener | 280/11.221 |
| D479,868 | S | * | 9/2003 | Ojeda, III | D21/772 |
| 6,648,372 | B2 | * | 11/2003 | Ojeda, III | 280/809 |
| 2003/0160441 | A1 | * | 8/2003 | Ojeda, III | 280/809 |
| 2003/0178804 | A1 | * | 9/2003 | Lee | 280/87.042 |

* cited by examiner

*Primary Examiner*—Christopher P. Ellis
*Assistant Examiner*—Jeff Restifo
(74) *Attorney, Agent, or Firm*—Parsons & Goltry; Robert A. Parsons; Michael W. Goltry

(57) ABSTRACT

A truck with a discrete shield for skateboards and the like is described. A base has at least one truck assembly affixed to the underside thereof that mounts wheels. The truck assembly defines a lower surface between the wheels that is susceptible to damage. A discrete sheet of material has a smooth, low-friction surface and is formed to encircle portions of the truck assembly so as to hold the sheet of material in a fixed position underlying and covering the lower surface of the truck with the smooth, low-friction surface directed downwardly.

7 Claims, 6 Drawing Sheets

SKATEBOARD TRUCK SHIELD

FIELD OF THE INVENTION

This invention relates to shields for skateboard trucks.

More particularly, the present invention relates to shields for skateboard trucks that provide a friction-free truck-protective surface and are replaceable.

BACKGROUND OF THE INVENTION

While the sport of skateboarding has been known for some time, it has become immensely popular in the past few years. Further, skateboarding has primarily been a street sport for teens but there are currently many public and private skate-parks in the United States, with skateboarding being recognized as a viable form of recreation and physical activity for today's contemporary youth. Skateboards are elongated boards or platforms designed to hold a person, generally, in a standing position. Pairs of wheels are attached to the underside of the board near the front and the back by devices commonly referred to as trucks.

Skateboarding generally includes travel over smooth surfaces, which may be flat, curved, or slanted, to allow for fast easy movement. A common maneuver or stunt performed by skateboarders with some degree of skill is to "grind" the skateboard on objects and surfaces such as rails and curbs. In this maneuver the wheels are free of the surface and only the trucks are engaged to slide along the object. As can be readily understood, this sliding of the trucks on various objects can produce substantial wear on the trucks. Also, substantial slowing of the skateboarder occurs during the maneuver and the skateboarder can actually get hung up on a rail or curb, resulting in spills, falls, or wipeouts, which can result in painful cuts, abrasions, contusions, and possibly even broken bones.

Some attempts have been made to form the trucks with a smooth surface to enhance the grinding maneuver. However, the wear on these trucks is still substantial and the trucks must be replaced periodically. In the past it has been customary to apply skate wax or otherwise treat the surfaces, in advance, over which the grinding was to occur. However, this requires substantial time and effort in advance and is relatively costly, since a substantial amount of skate wax is required. Also, if the waxing is done in a public area there is an increased risk of other pedestrians slipping when holding onto a waxed railing or when stepping off of a waxed curb.

It would be highly advantageous, therefore, to remedy the foregoing and other deficiencies inherent in the prior art.

Accordingly, it is an object the present invention to provide new and improved skateboard truck shields that provide a smooth surface for grinding maneuvers and the like.

Another object of the present invention is to provide new and improved skateboard truck shields that provide a smooth safe surface for maneuvers such as grinding and the like.

Another object of the present invention is to provide new and improved skateboard truck shields that are simple and inexpensive to manufacture.

And another object of the present invention is to provide new and improved skateboard truck shields that are easily installed or replaced by the skateboard operator with a minimum amount of effort.

SUMMARY OF THE INVENTION

Briefly, to achieve the desired objects of the instant invention in accordance with a preferred embodiment thereof, provided is discrete truck shield for skateboards and the like including a sheet of material having at least one smooth, low-friction surface and defining several holes therethrough. The holes through the sheet of material are positioned to encircle a pivot strut and a mounting post of a truck assembly so as to hold the sheet of material in a fixed position underlying and covering a lower surface of the truck assembly with the at least one smooth, low-friction surface directed downwardly. In the preferred embodiment, the sheet of material includes ultra-high molecular weight polyethylene. Also, a truck shield is provided to protect the lower surfaces of both front and rear trucks of skateboards or surfaces between wheels on in-line skates and the like.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
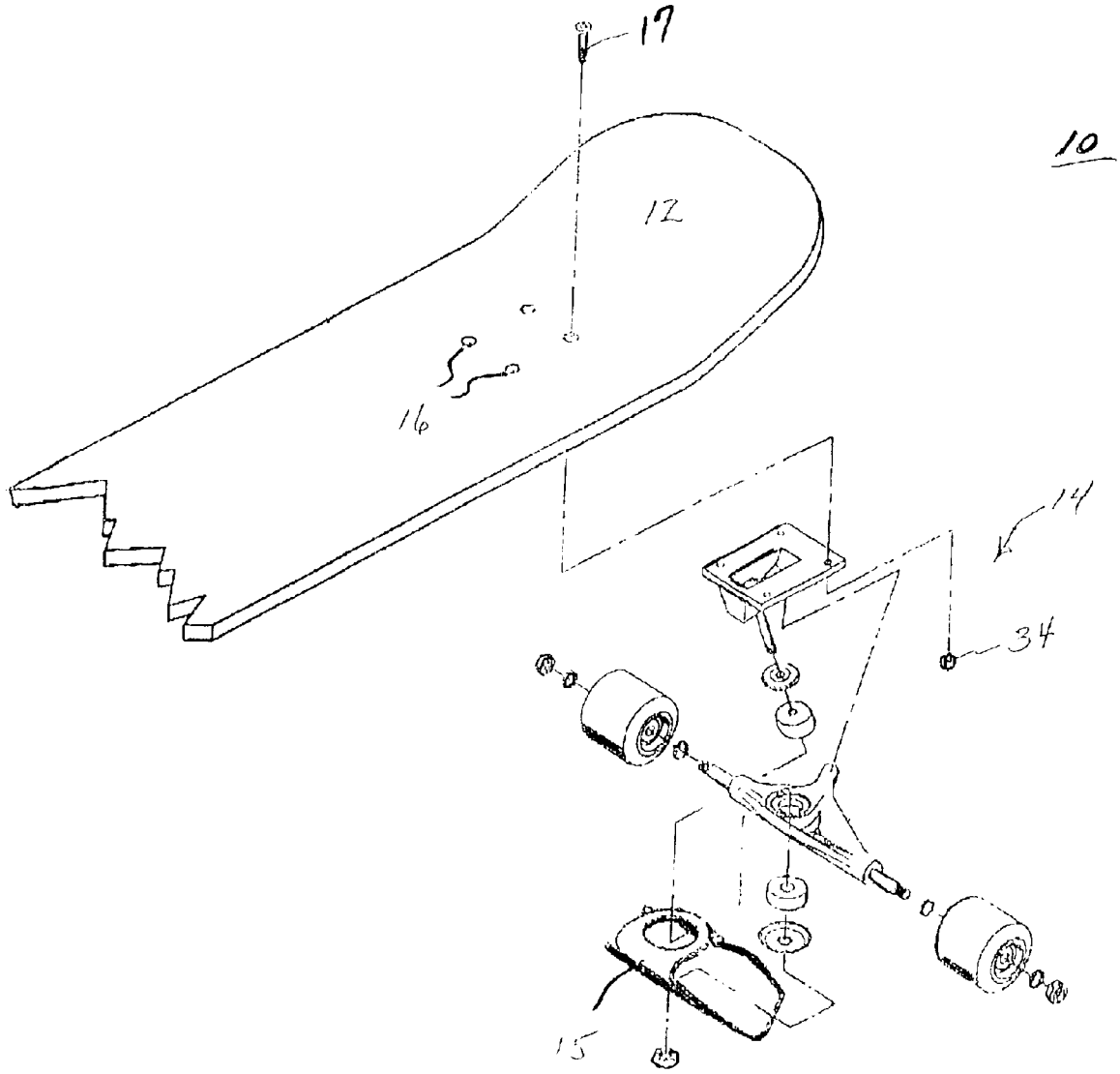
FIG. 1 is an exploded view in perspective of a skateboard, portions thereof removed, and skateboard truck shield in accordance with the present invention.

Turning now to the drawings in which like reference characters indicate corresponding elements throughout the several views, attention is directed to FIG. 1, which illustrates a portion of a skateboard 10 in an exploded perspective view. Skateboard 10 includes a board 12 and a truck assembly 14. Also, a truck shield 15, in accordance with the present invention, is illustrated. Board 12 has holes 16 formed therethrough for receiving screws 17 to mount truck assembly 14 onto the lower surface thereof. It will of course be understood that truck assembly 14 can be mounted in a variety of different ways, none of which are a portion of this invention.

Figure 2:
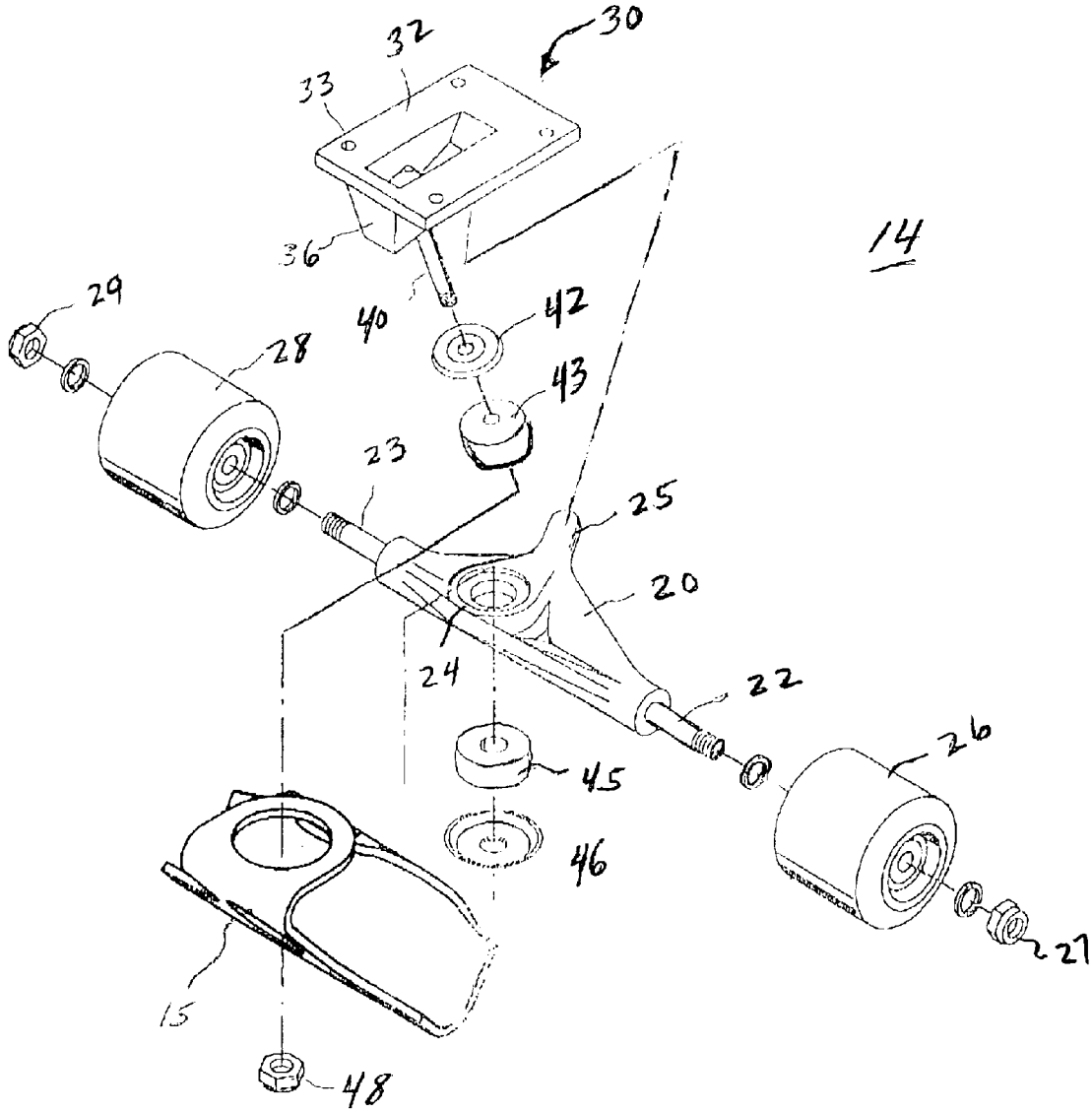
FIG. 2 is an enlarged exploded view in perspective of the skateboard truck and truck shield of FIG. 1.

Referring additionally to FIG. 2, truck assembly 14 includes a generally T-shaped truck 20 with axles 22 and 23 extending outwardly in opposite directions, transverse to the longitudinal axis of board 12. A mounting opening 24 is formed vertically through truck 20 at approximately midway between axles 22 and 23. A pivot strut 25 extends rearwardly and upwardly to form the body of the T. A wheel 26 is rotatably engaged on axle 22, with washers on each side, and is held in place by a nut 27 threadedly engaged on the end of axle 22. A wheel 28 is rotatably engaged on axle 23, with washers on each side, and is held in place by a nut 29 threadedly engaged on the end of axle 23.

A truck mount 30 includes a flat rectangular base 32 designed to be positioned against the underside of board 12. Mount 30 is held in place by screws 17 extending through holes 33 in base 32 and secured by self-locking nuts 34 (see FIG. 1). A downwardly extending housing 36 is formed as an integral portion of base 32 to provide sufficient vertical space between wheels 26 and 28 and the under surface of board 12. A mounting post 40 extends downwardly from the lower surface of housing 36 and is threaded at the lower end.

In the normal assembly of truck assembly 14 onto board 12, a washer 42 and rubber bushing 43 are positioned on mounting post 40. Truck 20 is then positioned on mounting post 40 by means of mounting opening 24 and pivot strut 25 is engaged in an opening in housing 36. A rubber bushing 45 and washer 46 are then positioned on mounting post 40 beneath truck 20 and a nut 48 is threadedly engaged on the end of mounting post 40 to hold the entire assembly in place. Here it should be understood that the truck assembly illustrated is simply one embodiment used for purposes of this explanation and a large variety of skateboards and truck assemblies are available and can be used in conjunction with the present invention.

Figure 3:
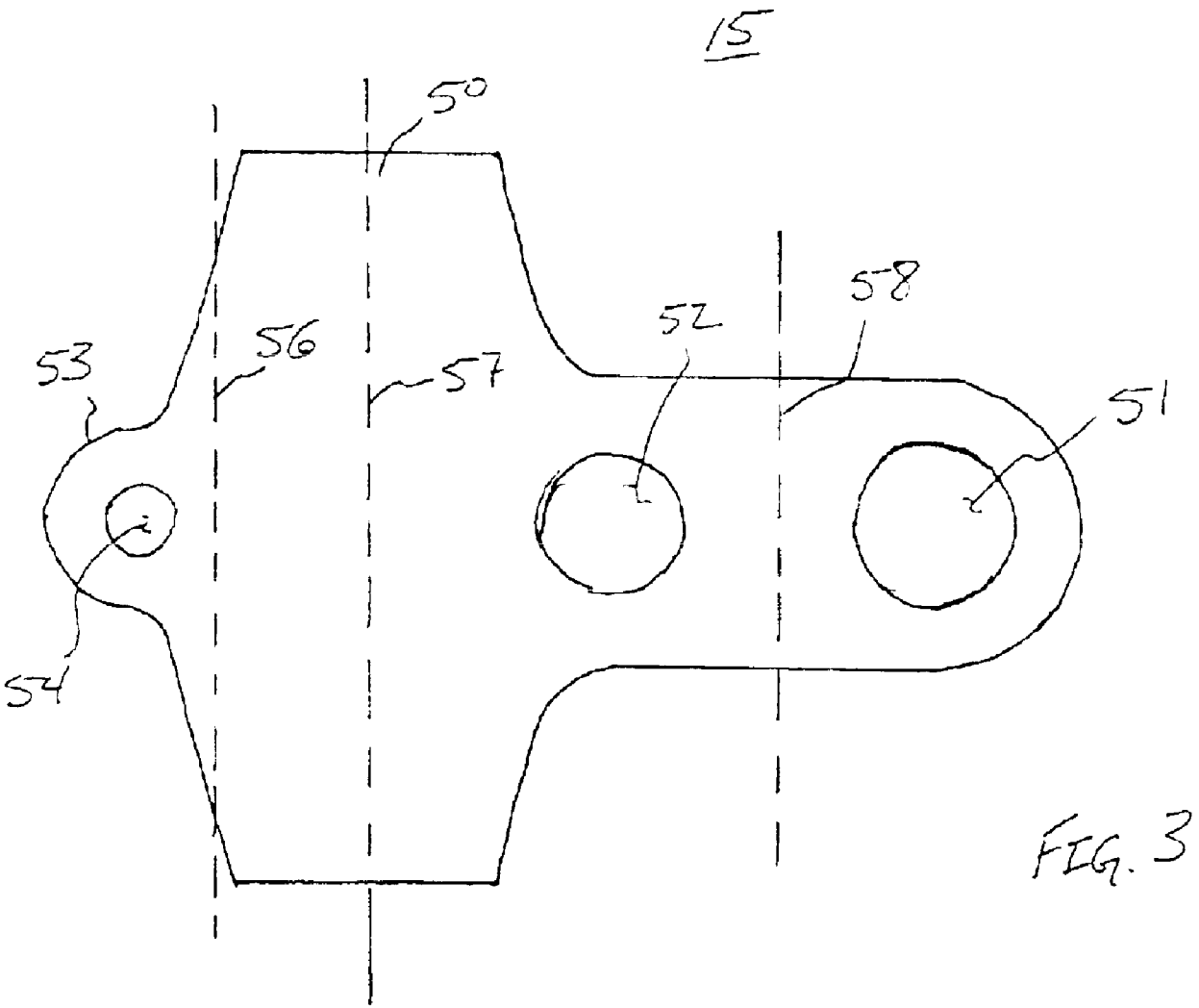
FIG. 3 is an enlarged plan view of the truck shield of FIG. 1.

Referring now to FIG. 3, a plan view of a discrete truck shield 15 is illustrated. For purposes of this disclosure a specific embodiment of truck shield 15 is illustrated and described with the understanding that various measurements and materials are included only for purposes of this explanation and can actually vary widely. Truck shield 15 is cut with a generally T-shape from a flat sheet 50 of ultra-high molecular weight polyethylene. Here it will be understood that this material is preferred for its strength, workability, and smoothness but other materials could be used, including some plastics with similar qualities and some metals and/or combinations of these materials. The cross member measures approximately seven inches across and two inches wide at the arms of the T, and the body of the T measures approximately three inches long and two inches across. A first hole 51 is centered approximately one inch from the rear end of the body and measures approximately one and one-eighth inches in diameter. A second hole 52 is centered approximately three inches from the rear end of the body and measures approximately one inch in diameter. A rounded tab 53 is formed at the front end of the body (in front of the perpendicular arms) and a hole 54 is formed in the center of tab 53 with a diameter of approximately one-half inch.

Figure 6:
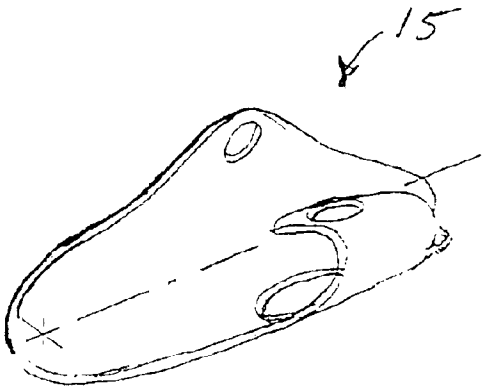
FIG. 6 is a rear perspective view of the truck shield of FIG. 4 oriented for installation.
Figure 5:
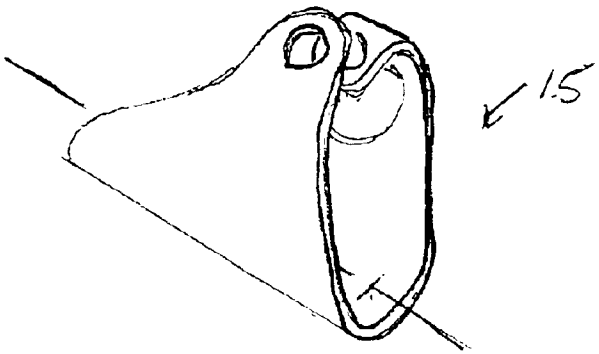
FIG. 5 is a front perspective view of the truck shield of FIG. 4 oriented for installation.
Figure 4:
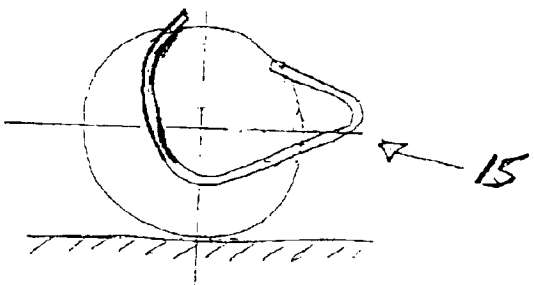
FIG. 4 is a side view of the truck shield of FIG. 1 oriented for installation, with the truck position illustrated in broken lines.
Figure 7:
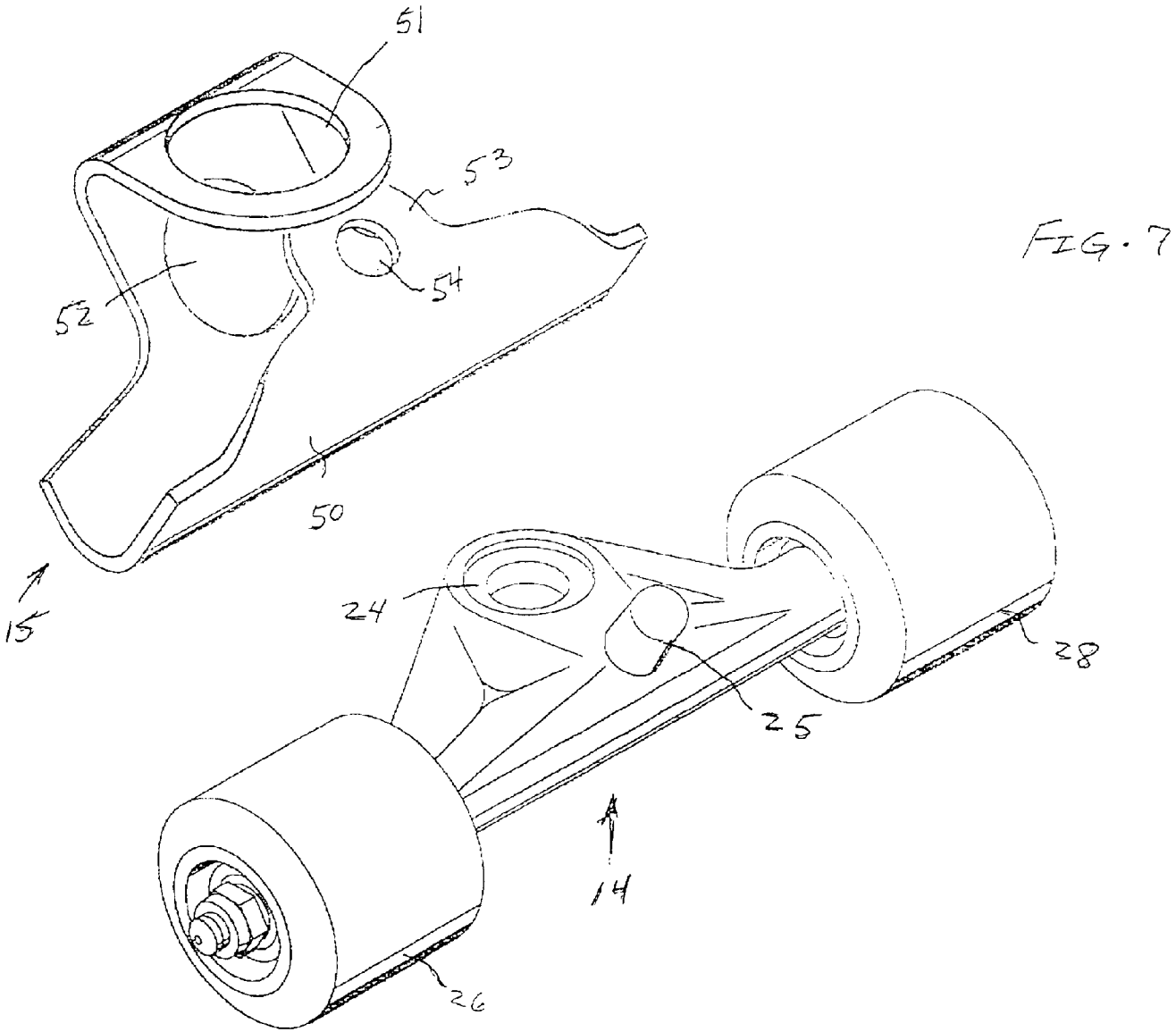
FIG. 7 is an enlarged view in perspective of the truck shield and truck, illustrating the relative positions prior to installation.

In the assembly of truck shield 15, flat sheet 50 is bent generally along broken lines 56, 57, and 58 to form a generally G-shaped discrete structure (truck shield 15) when viewed from the side (see FIG. 4). This folded configuration positions tab 53 at the top of truck shield 15 atop the wide cross member and holes 51 and 52 one atop the other, with hole 51 on top of hole 52 and generally axially aligned. Front and rear perspective views of folded generally G-shaped truck shield 15 are illustrated in FIGS. 5 and 6, respectively. Also, a view of truck shield 15 positioned in a correct orientation for mounting on truck 14 is illustrated in FIG. 7.

Figure 8:
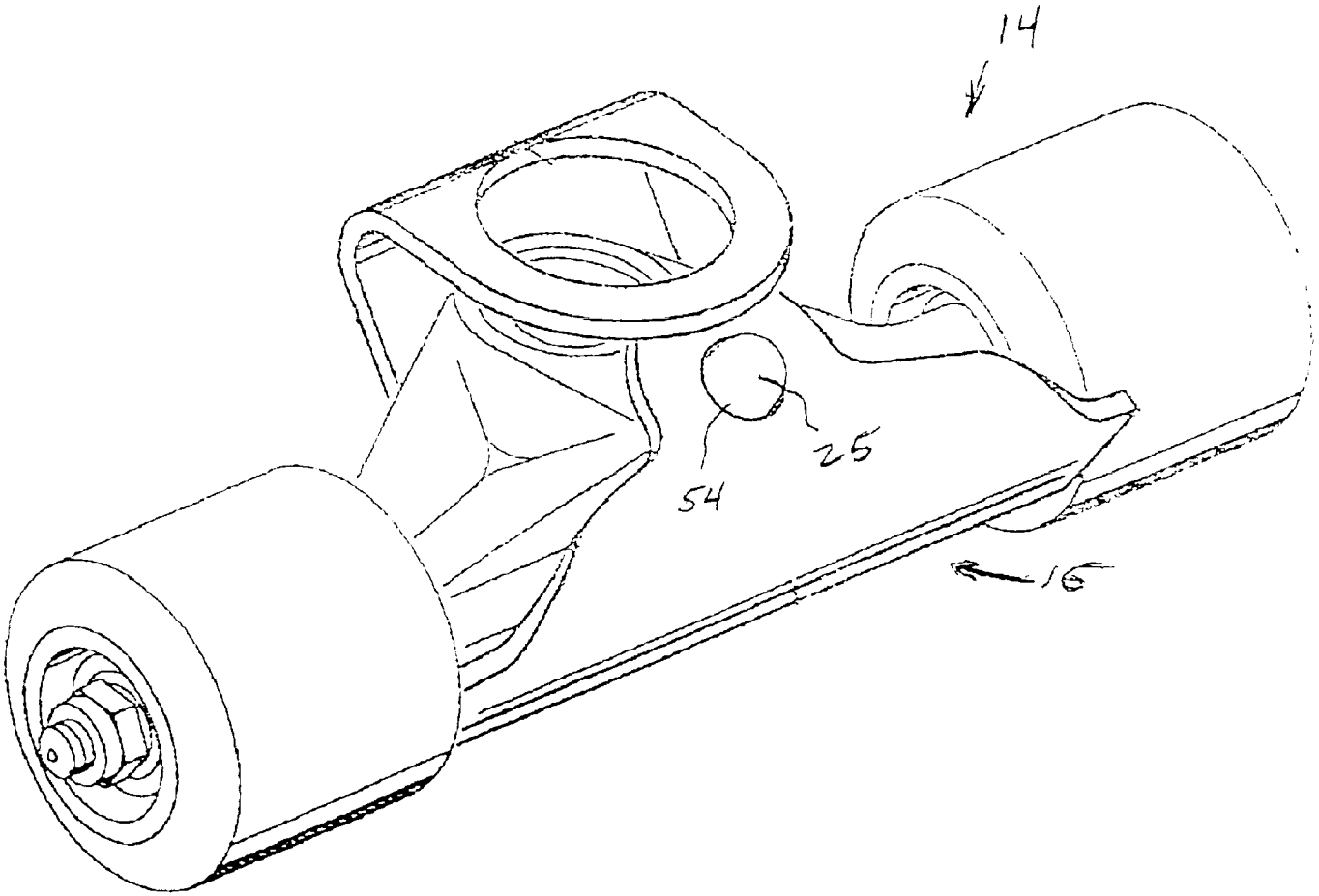
FIG. 8 is an enlarged view in perspective of the truck shield and truck, illustrating the relative positions during installation.

In the assembly of truck shield 15 onto truck 14, truck 14 is removed from mounting post 40 so as to be free, as illustrated in FIG. 8. Truck shield 15 is then positioned around truck 14 with hole 54 engaged over pivot strut 25. Hole 52 is positioned below mounting opening 24 and hole 51 is positioned above mounting opening 24 in substantial axial alignment. Truck 14 is then reattached to mounting post 40 of truck mount 30 by inserting mounting post 40 through, washer 42, rubber bushing 43, hole 51 mounting opening 24 in truck 14, hole 52, rubber bushing 45, and washer 46. With the entire assembly in position, nut 48 is threaded onto mounting post 40 to lock it firmly in place. Here it should be noted that rubber bushings 43 and 45 can, if desired, generally pass through holes 51 and 52, respectively, but washer 46 secures truck shield 15 in place. Also, while only one truck has been illustrated it will be understood that both trucks are substantially similar and assembly of a second truck shield 15 on the second truck will be similar.

Thus, to use skateboard truck shield 15 the skateboarder simply installs a pair of them as described above. The skateboarder can then perform grinding maneuvers or stunts in the conventional manner. Truck shields 15 surround the skateboard trucks, front and back, to provide a smooth virtually frictionless surface between the trucks and rails, curbs, and other objects when grinding the board. The truck shields eliminate the need to apply skate wax to such objects and surfaces and protect the trucks from wear and damage. Further, in the event of wear on the truck shields, because they are discrete and not a portion of the trucks, are easily and quickly replaced with new shields. Here it should be noted that similar shields can be placed on in-line skates and on the tail of the skateboard, if desired.

Thus, new and improved discrete skateboard truck shields have been disclosed, which are easily installed and which are easy and inexpensive to manufacture. Specifically, the new and improved discrete skateboard truck shields reduce or eliminate the surface resistance of various objects and surfaces during grinding and wear on the trucks of the skateboard. Further, the new and improved skateboard truck shields are simple and inexpensive to manufacture and install and substantially improve the operation of skateboards.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A discrete truck shield comprising:

a sheet of material having at least one smooth, low-friction surface and defining holes therethrough positioned to encircle a pivot strut and mounting post of a truck assembly so as to hold the sheet of material in a fixed position underlying and covering a lower surface of the truck assembly with the at least one smooth, low-friction surface directed downwardly;

the sheet of material formed in a generally T-shaped configuration having arms and a perpendicular body, so that when the truck shield is properly positioned under a truck assembly the arms extend parallel to a truck included in the truck assembly and the body extends around the truck; and the holes defined in the sheet of material include a first hole adjacent one end of the truck shield body positioned to encircle the pivot strut and two additional holes adjacent an opposite end of the perpendicular body positioned to encircle the mounting post in axial alignment with one of the two additional holes positioned below the truck and the other of the two additional holes positioned above the truck.

2. A discrete truck shield as claimed in claim 1 wherein the sheet of material includes ultra-high molecular weight polyethylene.

3. A truck with a discrete shield comprising;

a base having at least one truck assembly affixed to the underside of the base and mounting wheels, the at least one truck assembly defining a lower surface between the wheels;

a discrete sheet of material having at least one smooth, low-friction surface and defining holes therethrough positioned to encircle portions of the truck assembly so as to hold the sheet of material in a fixed position underlying and covering the lower surface of the truck with the at least one smooth, low-friction surface directed downwardly;

the sheet of material is formed in a generally T-shaped configuration with arms and a perpendicular body, so that when the truck shield is properly positioned under the truck assembly the arms extend parallel to the truck assembly and the body extends around the truck assembly; and the holes defined in the sheet of material include a first hole adjacent one end of the truck shield body positioned to encircle a pivot strut of the truck assembly and two additional holes adjacent an opposite end of the truck shield body positioned to encircle a mounting post of the truck assembly in axial alignment with one of the two additional holes positioned below the truck assembly and the other of the two additional holes positioned above the truck assembly.

4. A truck with a discrete shield as claimed in claim 3 further including a front and a rear truck assembly each having a sheet of material with at least one smooth, low-friction surface positioned to encircle portions of the truck assembly so as to hold the sheet of material in a fixed position underlying and covering the lower surface of the truck assembly with the at least one smooth, low-friction surface directed downwardly.

5. A truck with a discrete shield as claimed in claim 3 wherein the sheet of material includes ultra-high molecular weight polyethylene.

6. A skateboard with discrete truck shields comprising;

an elongated board having an underside with a front and a rear truck assembly affixed thereto along a longitudinal axis, each of the front and rear truck assemblies including a truck with arms extending perpendicular to the longitudinal axis and wheels mounted adjacent outer ends, each of the trucks of the front and rear truck assemblies defining a lower surface between the wheels, each of the trucks of the front and rear truck assemblies including a pivot strut extending generally parallel to the longitudinal axis of the board, and each of the front and rear truck assemblies further including a mounting post affixed to the underside of the board for mounting each of the trucks of the front and rear truck assemblies;

a first sheet of material having at least one smooth, low-friction surface and formed into a generally T-shaped discrete first skateboard truck shield having a perpendicular body with transverse arms, the first skateboard truck shield including a first hole adjacent one end of the first skateboard truck shield body encircling the pivot strut of the truck of the front skateboard truck assembly and two additional holes adjacent an opposite end of the first skateboard truck shield body encircling the mounting post of the front skateboard truck assembly in axial alignment with one of the two additional holes positioned below the truck of the front skateboard truck assembly and the other of the two additional holes positioned above the truck of the front skateboard truck assembly, the first skateboard truck shield underlying and covering the lower surface between the wheels of the truck of the front skateboard truck assembly with the at least one smooth, low-friction surface directed downwardly; and a second sheet of material having at least one smooth, low-friction surface and formed into a generally T-shaped discrete second skateboard truck shield having a perpendicular body with transverse arms, the second skateboard truck shield including a first hole adjacent one end of the second skateboard truck shield body encircling the pivot strut of the truck of the rear skateboard truck assembly and two additional holes adjacent an opposite end of the second skateboard truck shield body encircling the mounting post of the rear skateboard truck assembly in axial alignment with one of the two additional holes positioned below the truck of the rear skateboard truck assembly and the other of the two additional holes positioned above the truck of the rear skateboard truck assembly, the second skateboard truck shield underlying and covering the lower surface between the wheels of the truck of the rear skateboard truck assembly with the at least one smooth, low-friction surface directed downwardly.

7. A skateboard truck shield as claimed in claim 6 wherein the first and second sheets of material each include ultra-high molecular weight polyethylene.

* * * * *